US010555589B2

(12) United States Patent
Hemesath

(10) Patent No.: US 10,555,589 B2
(45) **Date of Patent: *Feb. 11, 2020**

(54) PROTECTIVE CASE FOR MOBILE ELECTRONIC DEVICE WITH STORAGE COMPARTMENT

(71) Applicant: INCIPIO, LLC, Irvine, CA (US)

(72) Inventor: Timothy Hemesath, Clovis, CA (US)

(73) Assignee: Incipio, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/277,681

(22) Filed: Feb. 15, 2019

(65) Prior Publication Data

US 2019/0174893 A1 Jun. 13, 2019

Related U.S. Application Data

(63) Continuation of application No. 15/865,246, filed on Jan. 8, 2018, now Pat. No. 10,206,471.

(60) Provisional application No. 62/442,977, filed on Jan. 6, 2017.

(51) Int. Cl.
*A45C 11/00* (2006.01)
*A45C 11/18* (2006.01)

(52) U.S. Cl.
CPC ..... *A45C 11/00* (2013.01); *A45C 11/182* (2013.01); *A45C 2011/001* (2013.01); *A45C 2011/002* (2013.01); *A45C 2011/003* (2013.01); *A45C 2200/15* (2013.01)

(58) Field of Classification Search
CPC . A45C 11/00; A45C 2011/002; A45C 11/182; A45C 2011/001; A45C 2011/003; A45C 2200/15
See application file for complete search history.

(56) References Cited

U.S. PATENT DOCUMENTS

2008/0032758 A1* 2/2008 Rostami ..... A45C 11/00 455/575.8
2012/0037285 A1* 2/2012 Diebel ..... G06F 1/1626 150/165
2013/0025750 A1* 1/2013 Wingerter ..... A45C 1/02 150/149

* cited by examiner

*Primary Examiner* — Chuong A Ngo

(57) ABSTRACT

A protective case for a mobile device having a front cover and a storage compartment for a user's personal items such as credit cards, personal identification cards, and/or cash is disclosed. The protective case includes a main body and a detachable panel configured to cover an aperture through the shell of the protective case providing access to the storage compartment via a hinged connection. The shell, panel, and front are secured to flexible layers, which allow the case to function as independent pivot stands that can position the case in one or more operating/viewing positions.

20 Claims, 2 Drawing Sheets

PROTECTIVE CASE FOR MOBILE ELECTRONIC DEVICE WITH STORAGE COMPARTMENT

INCORPORATION BY REFERENCE TO RELATED APPLICATIONS

This application is a continuation of U.S. application Ser. No. 15/865,246, filed Jan. 8, 2018, which claims the benefit of priority under 35 U.S.C. § 119(e) to U.S. Provisional Application No. 62/442,977, filed Jan. 6, 2017. The above applications are hereby incorporated herein by reference in their entirety and are to be considered a part of this specification.

BACKGROUND OF THE INVENTION

Field of the Invention

This invention relates to user removable protective enclosures or cases for mobile electronic devices. More particularly this patent document relates to a unique and inventive implementation of a protective enclosure having a credit card storage compartment accessible beneath a hinged subpanel.

Description of the Related Art

Mobile consumer electronic products, such as smart and cellular phones, computing tablets, MP3/audio/video players, gaming devices and laptops are continuously and rapidly evolving to meet expanding consumer demands. Such devices are becoming more and more powerful, connected, and interactive, and employ bigger and bigger screens. For example, the recent generation of Apple's iPhone 6 Plus, introduced in September 2014, provides nearly double the screen space of the original iPhone (1$^{st}$ generation) introduced in 2007. However, mobile devices and particularly screens are susceptible to damage from impact or fluid/contaminant ingress. With ever increasing size, the mobile electronic devices become more suitable for multimedia and entertainment, while also occupying more and more space in a pocket or handbag. Users are looking to protect their mobile electronic devices while also optimizing multimedia performance and accommodating the convenient transport and use of such devices together with their personal items.

The inventors here have recognized that there is a need for protective cases for such mobile electronic devices that are capable of providing multiple viewing/operating positions and also conveniently storing and transporting personal items.

BRIEF SUMMARY OF THE INVENTION

Disclosed are numerous aspects of a unique and inventive protective case configured to receive, retain and protect a mobile device. Such mobile devices typically include a front face and a back face that define the height of the mobile device, a perimeter defined by a top, bottom, right, and left sides residing between the front and back faces, and corners defined at the intersecting regions of the faces and sides. The case may be for a mobile electronic device that is in the form of a mobile phone, a tablet, an MP3 audio player, a multimedia viewer, a laptop, an e-reader, a gaming device, a health tracker, a connected/IoT device, a personal AI assistant device, or some other portable handheld electronic device and may have one or more touchscreens and one or more inputs on its front face, back face, and/or its sides.

The protective case is, in a first aspect, comprised of three primary components, a shell, a front cover, and a flexible spine. The shell is dimensioned and configured to securely and removably retain the electronic device and includes a compartment for storing a personal item, the compartment being accessible beneath a hingedly attached subpanel. The front cover is dimensioned to approximate the front face of the electronic device with an additional curved perimeter region to partially curve around the front face of the mobile device to protect the entire mobile device and its corners. The flexible spine secures the front cover to the shell.

The shell may be comprised of a main body (or main body) and a detachable subpanel, each of which having an inner surface and an outer surface. The main body defines a cavity for containing the mobile electronic device and the compartment for containing a credit card or personal item. The shell includes an aperture through its back panel that is positioned to partially expose the compartment and dimensioned to receive the subpanel. The subpanel is positioned to correspond to the aperture formed in the main body and hinged along a first side to the main body and secured on a second side to the flexible spine. One or more attachment protrusions are provided and configured to mechanically secure the subpanel into the aperture of the main body at or near the second side or location to thereby secure the subpanel to the main body of the shell.

When the subpanel is attached or otherwise secured at the second side, the subpanel and main body maintain a fixed relative position and orientation to one another. The subpanel is dimensioned such that when it is positioned within the aperture of the main body, there is a slot or gap between opposing edges of the subpanel and the adjacent edge of the aperture. The shell also includes an indentation or a lip at one or more regions around the aperture that is dimensioned to engage with the corresponding edge or lip regions of the subpanel to prevent the subpanel from swinging into the mobile device compartment formed by the shell and its main body.

The cover generally is comprised of a front cover panel configured or dimensioned to include a perimeter that is coextensive in dimension with the front face of the mobile device so that it may cover the entirety of the touch screen of the mobile device. The flexible spine connects the front cover panel to the shell via the subpanel. The flexible spine component can be comprised of two opposing flexible inner and outer layers that are overlaid and secured on respective opposing inner and outer sides of the front cover panel, the subpanel, and some or all of the shell, including the panel. The opposing overlaid layers may form the hinge that connects the subpanel to the main body of the shell portion and attaches the shell component to the front cover component. The flexible spine is adapted to allow relative movement between the shell and cover components and to allow the cover to open and close over the shell when the case is opened and closed. The front cover includes a flap or tab at an end opposite the flexible spine, the flap or tab including an additional rigid flap insert and a flap securing mechanism, (e.g., a snap, magnet, latch, hook, or other mechanism). The flap securing mechanism engages a corresponding mechanism (e.g, a magnet, a snap, a latch, a hook, or other mechanism) on or in the back of the shell or the side of the shell opposite the flexible spine to secure the front cover in place relative to the shell. The inner face of the cover may include one or more slots or openings in the inner layer so as to create a wallet for credit cards and the like.

The front cover panel, the subpanel, the panel, and/or the flap insert may be formed of polycarbonate (PC), thermoplastic urethane (TPU), a thermoplastic elastomer (TPE), an acrylonitrile butadiene styrene (ABS), nylon, silicone rubber, a combination thereof, or any other rigid or semi-rigid polymer. The front cover panel, the subpanel, and the panel may instead be formed of wood, stone, metal, or other natural materials. The opposing flexible inner and outer layer of the flexible spine may be made of synthetic materials or organic textiles or fabrics. The flexible inner and outer layer may be made of the same material or may be selected from different materials providing different desirable benefits for the internal and external portions. For example, the internal layer may prioritize friction (to minimize credit card or electronic device slipping) and softness to avoid scratches, while the outer layer may prioritize durability, water-resistance, or fashionable textures. The inner layer may be configured to cover some, all, or most of the mobile device cavity defined by the shell portion including the inner faces of the main body and subpanels of the shell. The inner layer may also cover the inner face of the front cover panel, which is configured to be in contact with the front face of the mobile device when the case is in the closed position. Additional layers may also be co-molded or otherwise incorporated into the protective case.

In use, in a closed configuration, the subpanel is positioned and secured within the aperture of the shell and the front cover forms a cover for the shell, partially enclosing the mobile electronic device, a credit card secured behind the mobile electronic device beneath the subpanel. In a flat position, the subpanel remains positions and secured within the aperture of the shell, but the flexible spine lays flat, allowing the front cover to lay flat next to the shell (like an open book). In the flat configuration, the credit card remains secured behind the mobile electronic device and beneath the subpanel. In a stand configuration, the subpanel is disengaged and rotated away from the aperture and the flexible spine is flexed to position an edge of the shell to rest on the front cover, supporting the mobile electronic device in a landscape view. In the stand configuration, a credit card behind the mobile electronic device remains secured between the mobile electronic device and the panel; however, a portion of the credit card may be accessible through the aperture, as the subpanel is rotated away. In the open configuration, the subpanel is disengaged and rotated away from the aperture, revealing a credit card contained in the compartment behind the mobile electronic device, enabling a user to remove the credit card from the compartment through the aperture.

Rather than adding weight to the case to retain the case in the selected viewing position, retention is accomplished as a result of the force resulting from the weight of the mobile device contained within the case. Thus, the case may be manufactured or configured with light-weight materials and so that it would not hold an angled viewing position by itself without the mobile device contained therein. Rather, in one aspect, the case is preferably configured to be bias to a closed position where the subpanel and main body are generally parallel to one another and not rotated relative to one another. This may be achieved by securing the layers over the main body and subpanel of the shell while the subpanel is closed and thus the overlaid layers would naturally be in tension when the when the subpanel is opened and therefor bias the subpanel into the closed position.

It should be understood that each of the foregoing and various aspects, together with those set forth in the claims and summarized above and/or otherwise disclosed herein, including the drawings, may be combined to support claims for a device, apparatus, system, method of manufacture, and/or use without limitation.

BRIEF DESCRIPTION OF THE DRAWINGS

These and other features, aspects and advantages are described below with reference to the drawings, which are intended to illustrate, but not to limit, the invention. In the drawings, like reference characters denote corresponding features consistently throughout similar embodiments.

DETAILED DESCRIPTION OF THE PREFERRED EMBODIMENT

Figure 1:
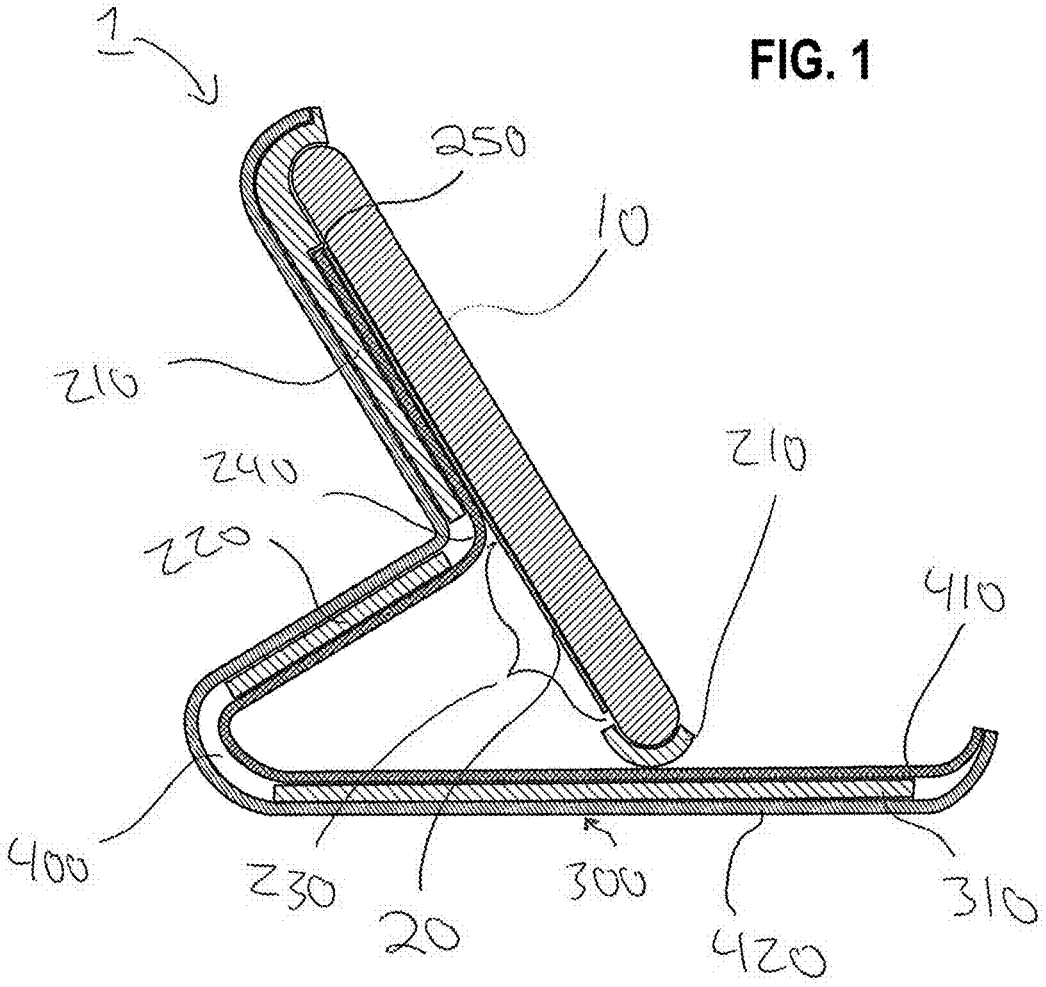
FIG. 1 is a cross-sectional view of a first embodiment of the protective enclosure containing a mobile device and a credit card in a stand configuration.
Figure 2:
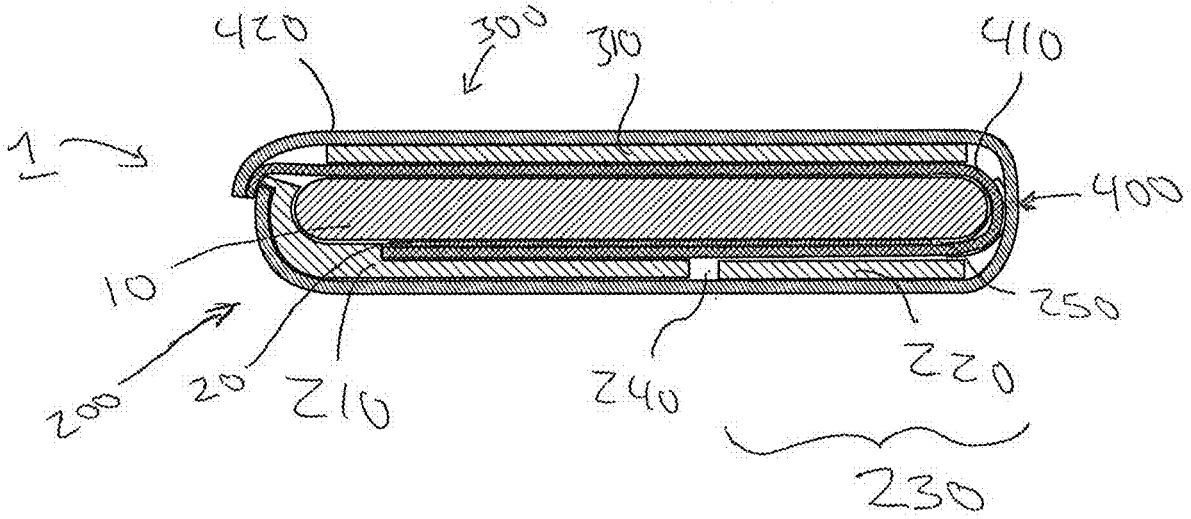
FIG. 2 is a cross-sectional view of a first embodiment of the protective enclosure containing a mobile device and a credit card in a closed configuration.
Figure 3:
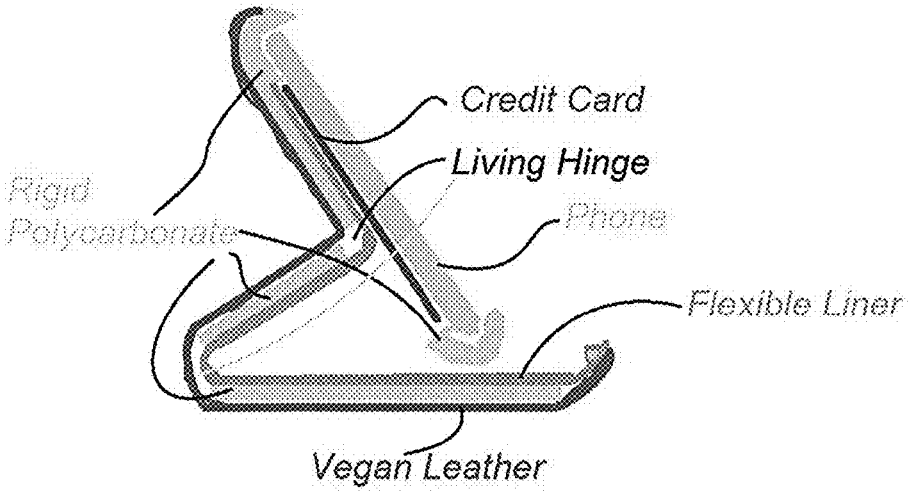
FIG. 3 is a cross-sectional view of a first embodiment of the protective enclosure containing a mobile device and a credit card in a stand configuration.
Figure 4:
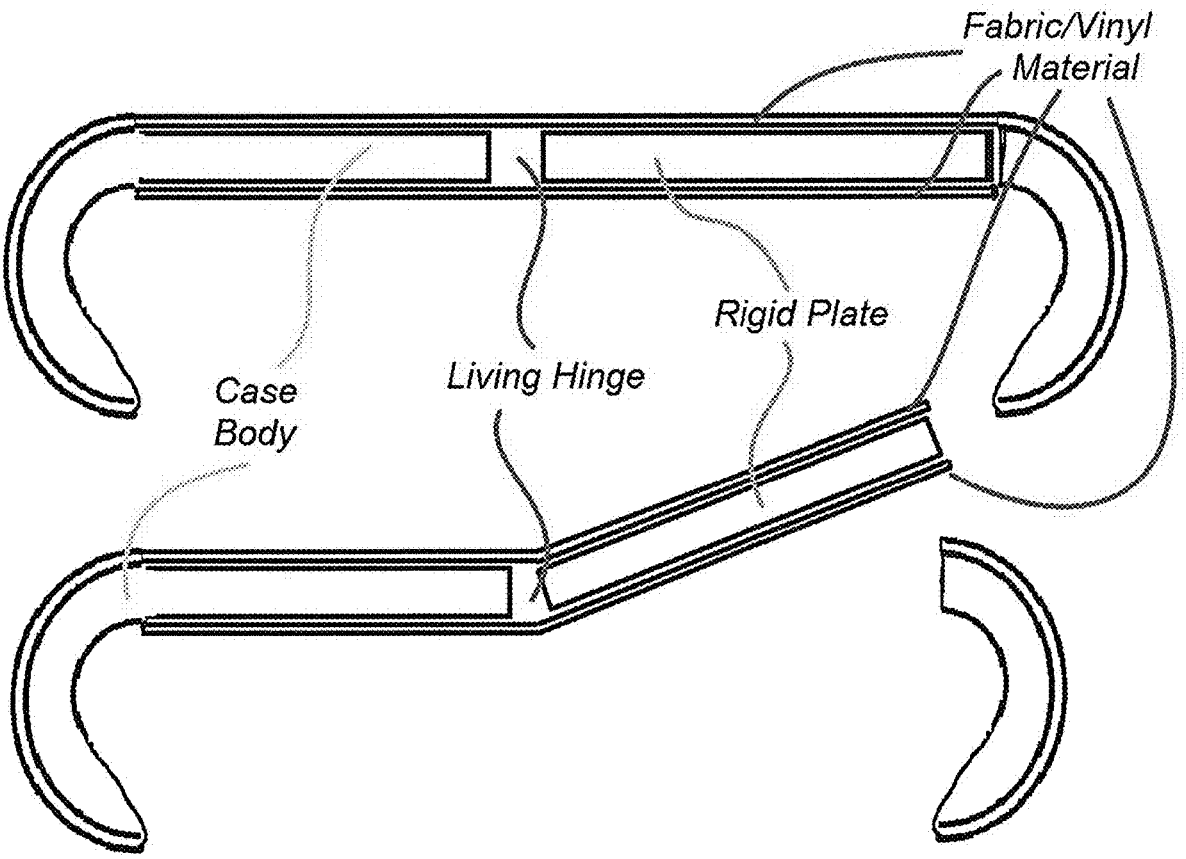
FIG. 4 includes cross-sectional views of a second embodiment of the protective enclosure containing a mobile device in closed and open configurations.

As summarized above and illustrated in the drawings, disclosed herein are various aspects of a protective case for a mobile device capable of providing user storage for personal items and different user viewing/operation positions while minimizing bulkiness and weight without sacrificing protection. Many of those aspects are summarized above and illustrated in the drawings.

Commonly disclosed in the figures, the protective enclosure or case 1 is generally configured to receive and protect a mobile device 10. The case 1 generally includes a shell 200 (comprised of a main body 210 and a subpanel 220) and a front cover 300 comprised of a front cover panel 310 that is attached to the shell 200 via a flexible spine 400. A flexible inner layer 410 and outer layer 420 overlay and are secured to opposing sides of the shell's main body or panel 210, the subpanel 220, front cover panel 330, and flap insert 321, connecting the components as a single continuous case 1 and enabling relative motion between components. Flexible inner layer 410 and flexible outer layer 420 are secured together between other components, forming the hinge 240 between the main body 210 and the subpanel 220, the flexible spine 400 between the subpanel 220 and the front cover 300, and allowing the flap or tab 320 to move relative to the front cover 300.

The protective case 1 may be for a mobile electronic device 10 that is in the form of a tablet, a smart or mobile phone, an MP3 audio player, a gaming device, or other portable handheld electronic device. Such mobile devices 10 typically include a front face and a back face, the difference between the two faces defining the height or thickness of the mobile device 10, a perimeter defined by top, bottom, right, and left sides residing between the front and back faces, and corners defined at the intersecting regions of the sides. The entirety, most, or a portion of the front face of the mobile device 10 may be comprised of a touch screen, possibly including one or more button and/or biometric scanner. Screens may be provided on other sides as well including the back face. The device 10 may have one or more buttons, controls, user interfaces, and/or ports included along its perimeter walls and a camera, flash, and speaker or microphone port on its back face.

The shell component 200 is generally defined by front (internal cavity) surface and opposing rear surface, left and right sides, and top and bottom ends. The front side or face of the shell 200 defines a cavity 255 that is configured to receive and retain the portable electronic device as well as a compartment 250 that is configured and dimensioned to receive and retain a personal item (e.g., an identification card, credit card, debit card, medical insurance card, money, or other items) 20, while allowing users to access the touchscreen on the front face of the electronic device 10 and to control interfaces on the device 10. The shell component 200 may be in the form of contoured molded polymer sub-portions including a main body 210 and a separate subpanel 220 corresponding to an aperture in the main body.

The main body 210 may also include additional apertures including a camera lens aperture 226 and a speaker and/or microphone aperture 228. Apertures may also be included in the subpanel 240, for example if the subpanel is configured to cover features on the mobile device. Perimeter regions in the shell 200 that reside between one or more of the corners may be removed. Mid-section regions of the shell 200 may be removed to allow for user utilization of device features that are located on the side walls and/or back face of the mobile device 10.

The main body 210 and subpanel 220 each have inner surfaces and outer surfaces respectively. The inner layer 410 and outer layer 420 sandwich the main body 210 and subpanel 220, with the inner layer 410 securing to the inner surfaces of the main body and subpanel and the outer layer 420 securing to the outer layer of the main body and subpanel. The inner and outer layers 410, 420 may be attached or adhered to one another and the interposed components (e.g., the shell panels and cover panel) via any suitable method including mechanical stitching, chemical adhesion, glue, heat sealing, or a combination thereof. Additional layers may be secured between either of the layers 410, 420 and any of the interposed or secured elements 210, 220, 300, 321 or even between the layers 410, 420 at the hinge 240 or flexible spine 400.

The aperture 230 through the shell's back surface is positioned to partially expose the personal item compartment 250 and dimensioned to receive the subpanel. The main body 210 and the subpanel 220 include overlapping lips or edges configured to provide a mechanical stop and keep the subpanel 220 from rotating into the cavity 255 and compartment 250 through the aperture. One or more attachment protrusions 260 are provided and configured to mechanically secure the subpanel 220 into the aperture 230 of the main body 210 at or near the second side or location to thereby secure the subpanel 220 to the main body 210 of the shell 200. The combination of the hinged connection 240 on one side and the mechanical detents or attachment protrusions 260 on the other side of the aperture 230, allow the subpanel 220 to rotatably lock and unlock into and out of the main body 210.

The subpanel 220 is positioned to correspond to the aperture formed in the main body 210 and a hinge 240 (formed by the inner layer 410 and outer layer secured together between the main body 410 and the subpanel 220) connects the subpanel 220 along a first side to the main body 210 and a flexible spine 400 (formed by the inner layer 410 and outer layer secured together between the subpanel 220 and the front cover panel 310) secures the subpanel 220 to the front cover panel 310 on a second side. In other embodiments, only an inner layer 410 may be used without an outer layer 420 or an outer layer 420 may be used without an inner layer 410 to connect the components of the case 1. Alternatively, the construction of the elements may be reversed from that as described, to include a single flexible layer sandwiched between the rigid elements, but otherwise acting as described throughout this document. Instead of (or in addition to) relying on the hinge 240 and flexible spine 400 formed by the joined inner layer 410 and outer layer 420, the subpanel 220 may be secured to the main body 210 by other rotatable connections or conventional hinge connections, including one or more of a living hinge, a pin and socket, or in some cases, the subpanel 220 may even be formed of a flexible material.

In the illustrated embodiment, the front face of the main body 210 of the shell 200 defines a cavity that is configured to snap onto and retain an iPhone™ smartphone 10 (not shown) securely within the cavity 255 and a credit card compartment 250 defined by the contoured walls of the main panel 220. Notably, the shell 200 is configured such that the main body 210 alone, without the subpanel 220, defines a retention cavity 255 that covers at least partially all or some of the four sides and at least a portion of the back face of the mobile device 10 and is adapted to snapping onto or over the mobile device 10 and securely retaining the electronic device 10 for which it is configured to receive.

The personal item 20 is positioned in the compartment 250 behind the cavity 255, so that an electronic device 10 retained in the cavity 255 pressed the personal item 20 against the front wall of the shell 200. The personal item 20 may be retrieved from the compartment 250 by either removing the mobile electronic device 10 from the cavity 255, exposing the compartment 250, or by rotating the subpanel 220 away from the main body 210 to expose the aperture 230, allowing a user to retrieve the personal item 20 from the compartment 250 through the aperture 230, even when an electronic device 10 is retained in the cavity 255. The subpanel 220, therefore, is not required for retention of the mobile electronic device 10 in the cavity 255 of the shell 200, but is required to secure a personal item 20 in the compartment 250 behind the cavity 255.

The front cover component 300 is configured to cover the front face of the mobile device 10 when the case 1 is completely closed. The front cover 300 is defined by front (internal) surface, opposing rear surface, left, right, top and bottom edges or sides that correspond to the front, read, left, right, top and bottom sides of the shell 200 when the case 1 is in the completely closed position and the front cover 300 is on top of the shell 200. The front cover component 300 is comprised of a front cover panel 310, overlaid on opposing sides with the inner layer 410 and the outer layer 420. One or more slots or openings 330 may be formed into the inner layer 410 over the front cover panel 310 to form a wallet or credit card holder. Additionally, loops or pockets 340 may be formed on the front or rear surfaces of the front cover 300.

The components of the shell 200 may be made of any suitable material. For example, the shell components 210, 220 may be manufactured via injection molding using a suitable polymer such as polycarbonate and/or fiber (e.g., carbon or Kevlar) reinforced plastic or polymers. In other embodiments, case 1 could be constructed of natural materials including metal, bone, wood, or stone. The main body 210 of the shell 200 may be formed of the same or different material from the subpanel 220 of the shell 200. For example, the main body 210 may be formed of a more rigid material than the subpanel or vice versa. Similarly the front cover panel and flap insert 321 may be made of the same or different materials from the components of the shell 200. In some embodiments, securing mechanisms (such as flap securing mechanism 325) may require additional or specific materials, such as a magnetic flap securing mechanism 325 securing to a magnetic shell securing mechanism 270. In some embodiments, both securing mechanisms 270, 325 are magnetized, while in other embodiments only one securing mechanism 270, 325 is magnetized while the other is a magnetic material such as iron.

In order to bias the subpanel to the closed position, the layers 410, 420 may be adhered to each of the shell body 210 and subpanel 220 when they are oriented in the closed position. The inner layer 410 and outer layer 420 will therefore be biased (perhaps only slightly) against the subpanel 220 opening or hinging away from the main body 210 of the shell 200.

The inner surfaces of the main body and subpanel of the shell 200 include recessed regions or attachment areas dimensioned to receive correspondingly dimensioned inner layer 410 regions. Similarly, the outer surfaces of the main body and subpanel of the shell 200 include recessed regions dimensioned to receive correspondingly dimensioned outer layer 420 regions. Incorporating recessed regions in the inner and outer faces mitigates peeling of the flexible inner and outer layers 410, 420. Due to the recessed regions, the outer surfaces of the inner and outer layers 410, 420 are flush with or lower than the outer surfaces of the adjacent surrounding more rigid elements of the case 1.

In a stand configuration, the subpanel 220 may be disengaged by the user from the attachment protrusions 260 of the main body 210, allowing the main body 210 to pivot at the hinge 240 (relative to the subpanel 220), folding the case 1 over itself to form a different viewing or operating position as illustrated in the figures. Additionally, with the subpanel 220 pivoted away from the main body 210, the main body 210 can rotate at the hinge 240 away from the flexible spine 400 and over the inner face of the front cover 300. The proximate edge of the main body 210 of the shell 200 (i.e., the left side or edge) can be position to rest atop the inner face of the front cover 300 in a conveniently angled, landscape viewing position or stand configuration. The weight of the mobile electronic device 10 retained in the shell 200 maintains the case 1 in the desired stand configuration. By using the weight of the mobile device 10 to provide the added weight or force necessary to bias the case 1 into a desired viewing or operating position, the case 1 can be manufactured using lighter materials.

A corresponding method of manufacture is also disclosed. A shell 200 (including a main body 210 and subpanel 220) and a front cover 300 as described above may be molded or formed and then overlaid between flexible inner and outer layers 410, 420. A hinge 240, connecting the subpanel 220 over an aperture 230 in the main body 210 of the shell 200, is provided between the subpanel 220 and the main body 210 along a first side or edge. The hinge 240 may be formed by the overlaid inner and/or outer layers 410, 420. The inner 410 and/or outer 420 layers may be overlaid when the subpanel 220 and the main body 210 are in the closed position to bias the case into the closed position.

Each of the foregoing and various aspects, or teachings herein together with those set forth in the claims and described in connection with the embodiments of the protective cases summarized above or otherwise disclosed herein including the drawings may be combined to form claims for a device, apparatus, system, method of manufacture, and/or use without limitation.

Although the various inventive aspects are herein disclosed in the context of certain preferred embodiments, implementations, and examples, it will be understood by those skilled in the art that the present invention extends beyond the specifically disclosed embodiments to other alternative embodiments and/or uses of the invention and obvious modifications and equivalents thereof. In addition, while a number of variations of the various aspects have been shown and described in detail, other modifications, which are within their scope will be readily apparent to those of skill in the art based upon this disclosure. It should be also understood that the scope this disclosure includes the various combinations or sub-combinations of the specific features and aspects of the embodiments disclosed herein, such that the various features, modes of implementation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A user-removable protective case for retaining and protecting a mobile electronic device and containing a personal item, the protective case comprising:

an inner layer;

an outer layer;

a shell formed by a main body and a subpanel, at least a portion of the main body and the subpanel are sandwiched by the inner layer and the outer layer, the subpanel is coupled to the main body through a hinge, a cavity dimensioned to retain the mobile electronic device is formed by the shell;

a front cover formed by a cover panel that is positioned between the inner layer and the outer layer, the cover panel is coupled to the subpanel of the shell through a flexible spine;

a compartment dimensioned to retain the personal item is formed into the inner layer of the shell; and an aperture positioned and dimensioned to enable the personal item contained in the compartment to be inserted into and removed from the protective case when the subpanel is hingedly rotated away from the main body.

2. The protective case of claim 1, wherein the hinge coupling the main body and the subpanel of the shell is formed by the inner layer and the outer layer.

3. The protective case of claim 1, wherein the flexible spine coupling the cover panel of the front cover and the subpanel of the shell is formed by the inner layer and the outer layer.

4. The protective case of claim 1, wherein the front cover is dimensioned to cover a front face of the mobile electronic device when the mobile electronic device is retentively received within the shell and the case is in a completely closed position.

5. The protective case of claim 4, wherein a flap securing mechanism is provided to secure the case in the closed position.

6. The protective case of claim 5, wherein the flap securing mechanism comprising one or more magnets.

7. The protective case of claim 4, wherein the inner and outer layers are adhered to each of the body and subpanel when they are oriented in the closed position.

8. The protective case of claim 1, wherein the subpanel is configured to pivotally move away from the main body so that the shell can be folded to provide additional use configurations.

9. The protective case of claim 8, wherein the main body of the shell can rotate at the hinge away from the flexible spine and over an inner face of the front cover.

10. The protective case of claim 8, wherein a proximate edge of the main body of the shell can be positioned to rest atop an inner face of the front cover in a conveniently angled, landscape viewing position or stand configuration.

11. The protective case of claim 10, wherein the weight of the mobile electronic device retained in the shell maintains the case in the stand configuration.

12. The protective case of claim 1, wherein one or more pockets are formed on the front cover.

13. The protective case of claim 1, wherein the personal item is retrieved from the compartment by removing the mobile electronic device from the cavity to expose the compartment.

14. The protective case of claim 1, wherein the personal item is retrieved from the compartment by rotating the subpanel away from the main body to expose the aperture when the electronic device is retained in the cavity.

15. The protective case of claim 1, wherein the main body and the subpanel of the shell are manufactured via injection molding using a polycarbonate.

16. The protective case of claim 1, wherein the main body of the shell is formed of a more rigid material than the subpanel of the shell.

17. The protective case of claim 1, wherein the main body and the subpanel of the shell are made of the same material as that of the cover panel of the front cover.

18. The protective case of claim 1, wherein the main body of the shell including one or more recessed regions dimensioned to receive correspondingly dimensioned inner layer.

19. The protective case of claim 1, wherein the main body of the shell including one or more recessed regions dimensioned to receive correspondingly dimensioned outer layer.

20. The protective case of claim 1, wherein the subpanel of the shell including one or more recessed regions dimensioned to receive correspondingly dimensioned inner layer, and wherein the subpanel of the shell including one or more recessed regions dimensioned to receive correspondingly dimensioned outer layer.

* * * * *